US011228830B2

(12) United States Patent
Higgins et al.

(10) Patent No.: US 11,228,830 B2
(45) Date of Patent: Jan. 18, 2022

(54) HEARING DEVICE INCLUDING A SENSOR AND HEARING SYSTEM INCLUDING SAME

(71) Applicant: Starkey Laboratories, Inc., Eden Prairie, MN (US)

(72) Inventors: Sidney A. Higgins, Maple Grove, MN (US); Kyle Olson, St. Louis Park, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 38 days.

(21) Appl. No.: 16/571,837

(22) Filed: Sep. 16, 2019

(65) Prior Publication Data

US 2020/0092632 A1 Mar. 19, 2020

Related U.S. Application Data

(60) Provisional application No. 62/732,079, filed on Sep. 17, 2018.

(51) Int. Cl.

| | |
|---|---|
| ***H04R 1/10*** | (2006.01) |
| ***H04R 25/02*** | (2006.01) |
| ***H04R 25/00*** | (2006.01) |

(52) U.S. Cl.

CPC ..... *H04R 1/1066* (2013.01); *H04R 25/02* (2013.01); *H04R 25/70* (2013.01)

(58) Field of Classification Search

CPC combination set(s) only.

See application file for complete search history.

(56) References Cited

U.S. PATENT DOCUMENTS

| | | | |
|---|---|---|---|
| 4,893,344 | A | 1/1990 | Trägardh et al. |
| 5,048,090 | A | 9/1991 | Geers |
| 8,073,175 | B2 | 12/2011 | Watanuki |
| 9,131,312 | B2 | 9/2015 | LeBoeuf et al. |

(Continued)

FOREIGN PATENT DOCUMENTS

| | | | |
|---|---|---|---|
| EP | 3264798 | 1/2018 | |
| EP | 3264798 A1 * | 1/2018 | ..... H04R 25/407 |

(Continued)

OTHER PUBLICATIONS

International Search Report and Written Opinion dated Nov. 14, 2019 from PCT Application No. PCT/US2019/051437, 13 pages.

*Primary Examiner* — Fan S Tsang
*Assistant Examiner* — Julie X Dang
(74) *Attorney, Agent, or Firm* — Mueting Raasch Group

(57) ABSTRACT

Various embodiments of a hearing device and a system of using such device are disclosed. The hearing device includes a housing, electronic components disposed within the housing, and an earpiece adapted to be disposed in an ear canal of the ear of the wearer. The device also includes a sensor adapted to be in contact with a portion of the ear of the wearer, where the sensor is further adapted to detect a physiological characteristic of the wearer and generate a sensor signal based on the physiological characteristic that is received by a controller of the electronic components disposed within the housing; and a cable that operatively connects the sensor to the earpiece, where the cable is biased to maintain contact between the sensor and the portion of the ear of the wearer when the earpiece is disposed in the ear canal of the wearer.

20 Claims, 4 Drawing Sheets

(56) References Cited

U.S. PATENT DOCUMENTS

| | | | | |
|---|---|---|---|---|
| 9,532,748 | B2 | 1/2017 | Denison et al. | |
| 2006/0094974 | A1* | 5/2006 | Cain | A61B 5/6816 600/544 |
| 2008/0025541 | A1* | 1/2008 | Watanuki | H04R 25/65 381/330 |
| 2008/0200774 | A1* | 8/2008 | Luo | A61B 5/14551 600/301 |
| 2010/0048982 | A1* | 2/2010 | Puria | H04R 25/606 600/25 |
| 2012/0082329 | A1* | 4/2012 | Neumeyer | H04R 25/65 381/314 |
| 2013/0343585 | A1* | 12/2013 | Bennett | H04R 25/554 381/315 |
| 2014/0316230 | A1* | 10/2014 | Denison | A61B 5/165 600/383 |
| 2014/0321682 | A1* | 10/2014 | Kofod-Hansen | H04R 25/30 381/315 |
| 2015/0124976 | A1* | 5/2015 | Pedersen | A61N 1/37252 381/23.1 |
| 2017/0316192 | A1* | 11/2017 | Razouane | G06F 21/40 |

FOREIGN PATENT DOCUMENTS

| | | | | |
|---|---|---|---|---|
| EP | 3267698 | | 1/2018 | |
| EP | 3267698 | A1 * | 1/2018 | A61B 5/0476 |

* cited by examiner

HEARING DEVICE INCLUDING A SENSOR AND HEARING SYSTEM INCLUDING SAME

CROSS-REFERENCE TO RELATED APPLICATION

This application claims the benefit of U.S. Provisional Application No. 62/732,079, filed Sep. 17, 2018, the disclosure of which is incorporated by reference herein in its entirety.

BACKGROUND

Hearing devices, such as hearing aids, can be used to transmit sounds to one or both ear canals of a wearer. Some hearing devices can include electronic components disposed within a housing that is placed in a cleft region that resides between an ear and a skull of the wearer. Such housings typically can be connected to an earpiece that is disposed in an ear canal of the ear of the wearer.

For hearing devices such as hearing aids, a behind-the-ear (BTE) hearing aid can utilize tubing or wires that connect the housing of the hearing aid to the earpiece disposed in the ear. The housing can include a rectangular cross-section and a curved shape that can follow a contour of the cleft region between the ear and the skull of the wearer.

Further, body-worn devices can include one or more sensors that can measure one or more physiological characteristics of the wearer. For example, devices worn on the wrist or chest can be utilized to measure a heart rate of the wearer. Further, finger-worn devices can be utilized to measure oxygen content of blood of the wearer. These one or more sensors can be disposed in any suitable location on the wearer's body. For example, a hearing device can include a sensor that is disposed, e.g., on a portion of an ear of a wearer. Such sensor can be utilized to measure a physiological characteristic of the wearer such as pulse and body temperature.

SUMMARY

In general, the present disclosure provides various embodiments of a hearing device and a hearing system that includes such device. The hearing device can include a sensor that is adapted to be disposed such that it is in contact with a wearer of the hearing device. The sensor can be operatively connected to at least one of a housing or an earpiece of the hearing device by a cable that is biased to maintain contact between the sensor and the wearer when the earpiece is disposed in an ear canal of the wearer. In one or more embodiments, the cable can include a shape-memory material (e.g., nitinol) that biases the cable such that the sensor maintains contact with the wearer.

In one aspect, the present disclosure provides a hearing device that includes a housing adapted to be worn on or behind an ear of a wearer; electronic components disposed within the housing, where the electronic components include a controller; and an earpiece adapted to be disposed in an ear canal of the ear of the wearer, where the earpiece is operatively connected to the electronic components disposed within the housing. The device further includes a sensor adapted to be in contact with a portion of the ear of the wearer, where the sensor is further adapted to detect a physiological characteristic of the wearer and generate a sensor signal based on the physiological characteristic that is received by the controller of the electronic components disposed within the housing; and a cable that operatively connects the sensor to the earpiece, where the cable is biased to maintain contact between the sensor and the portion of the ear of the wearer when the earpiece is disposed in the ear canal of the wearer.

These and other aspects of the present disclosure will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

Throughout the specification, reference is made to the appended drawings, where like reference numerals designate like elements, and wherein.

DETAILED DESCRIPTION

Figure 1:
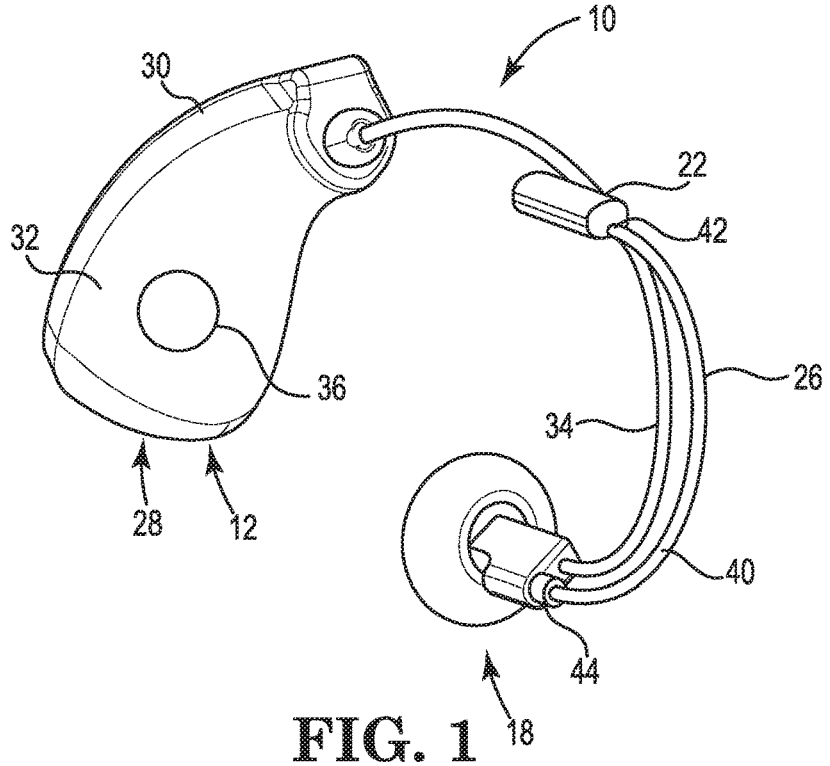
FIG. 1 is a schematic perspective view of one embodiment of a hearing device.
Figure 2:
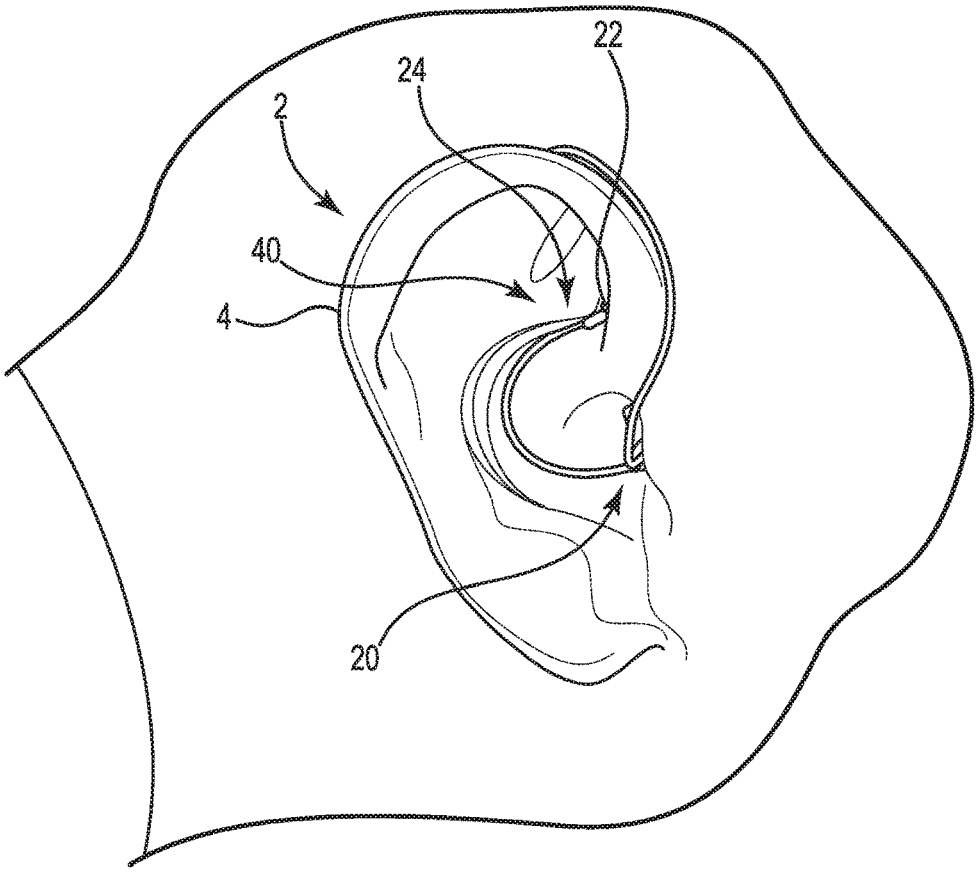
FIG. 2 is a schematic perspective view of the hearing device of FIG. 1 disposed on or behind an ear of a wearer.

In general, the present disclosure provides various embodiments of a hearing device and a hearing system that includes such device. The hearing device can include a sensor that is adapted to be disposed such that it is in contact with a wearer of the hearing device. The sensor can be operatively connected to at least one of a housing or an earpiece of the hearing device by a cable that is biased to maintain contact between the sensor and the wearer when the earpiece is disposed in an ear canal of the wearer. In one or more embodiments, the cable can include a shape-memory material (e.g., nitinol) that biases the cable such that the sensor maintains contact with the wearer.

Some sensors such as biosensors may require constant contact with a wearer for accurate detection of various physiological characteristics of the wearer such as pulse and body temperature. To maintain this constant contact with the wearer, current designs that are manufactured for an individual wearer require a custom molding or casting of the wearer's ear. The use of stock shapes or configurations, on the other hand, may sacrifice sensor accuracy for mass production. Further, normal activities such as walking, talking, exercising, and chewing may have to be curtailed when the sensor is utilized to detect a physiological characteristic as these activities can cause the sensor to at least temporarily lose contact with the wearer. In some devices, the sensor is disposed in the same housing or body as other electronic components of the hearing device. This tandem placement with other electronic components can result in additional costs for recovering the sensors from such hearing devices when the rest of the device is no longer usable.

Some currently-available hearing devices locate one or more sensors in the ear canal. These devices may, however, limit accuracy of the sensor, comfort for the wearer, and functionality of the hearing device while occupying limited space within the ear canal that may be needed for required hearing circuitry or components. The addition of sensors to hearing devices can also increase visibility of the devices while limiting their fit to an individual wearer. Further, an earpiece that includes a sensor can occlude a larger portion of the ear canal, which in turn can decrease perceived sound quality. Sensors are oftentimes embedded in a rigid polymer housing that may be required for accurate placement of the sensor. These rigid housings can reduce the comfort of the hearing device. And flexible polymer or elastomer sensor extensions or housings can lose their resiliency over time.

One or more embodiments of hearing devices described herein can provide various advantages over these currently-available devices. For example, the cable that operatively connects the sensor to at least one of the housing or the earpiece can include a shape-memory material that can adapt the hearing device to varying anatomies and accommodate common movements of the wearer while remaining securely and comfortably in place. In one or more embodiments, the cable can be adapted such that the sensor is in constant contact with the portion of the ear of the patient so that reading intermittencies are reduced, thereby increasing accuracy of the readings. Such cables can provide a spring-like resiliency that maintains the sensor in contact with the portion of the ear of the wearer without loss of shape memory of the cable.

FIGS. 1-5 are various views of one embodiment of a hearing device 10. The device 10 includes a housing 12 adapted to be worn on or behind an ear 2 of a wearer; electronic components 14 (FIG. 5) disposed within the housing, where the electronic components include a controller 16; and an earpiece 18 adapted to be disposed in an ear canal 20 of the ear of the wearer, where the earpiece is operatively connected to the electronic components disposed within the housing. The hearing device 10 also includes a sensor 22 adapted to be in contact with a portion 24 of the ear of the wearer, where the sensor is further adapted to detect a physiological characteristic of the wearer and generate a sensor signal based on the physiological characteristic that is received by the controller 16 of the electronic components 14 disposed within the housing 12; and a cable 26 that operatively connects the sensor to the earpiece 18, where the cable is biased to maintain contact between the sensor and the portion of the ear of the wearer when the earpiece is disposed in the ear canal 20 of the wearer.

The housing 12 can include any suitable housing utilized for a hearing device, e.g., one or more of the embodiments of housings described in U.S. patent application Ser. No. 15/799,064 to Sacha et al. and entitled HEARING DEVICE INCLUDING A SENSOR AND A METHOD OF FORMING SAME. The housing 12 can have any suitable dimensions and take any suitable shape or shapes. The housing 12 includes a housing body 28 and a top plate 30 that is connected to the housing body. The housing body 28 includes a side surface 32 and a second side surface (not shown). In one or more embodiments, the side surface 32 can be adapted to be disposed adjacent a pinna 4 of the ear 2 of the wearer. As used herein, the term "adjacent the pinna" means that the side surface 32 of the housing body 28 is disposed closer to the pinna 4 than to a skull of the wearer. In one or more embodiments, one or more portions of the side surface 32 are adapted to be disposed in contact with the pinna 4. In one or more embodiments, the second side surface can be adapted to be disposed adjacent the skull of the wearer. As used herein, the term "adjacent the skull" means that the second side surface is disposed closer to the skull than to the pinna 4 of the wearer. In one or more embodiments, one or more portions of the second side surface are adapted to be disposed in contact with the skull.

The housing 12 can be manufactured utilizing any suitable technique or techniques, e.g., injection-molding, 3D printing, etc. The housing 12 can include any suitable material or materials, e.g., silicone, urethane, acrylates, flexible epoxy, acrylated urethane, and combinations thereof. The housing body 28 can include the same material or materials utilized to form the top plate 30. In one or more embodiments, the housing body 28 can include a material that is different from the material utilized to form the top plate 30.

Figure 5:
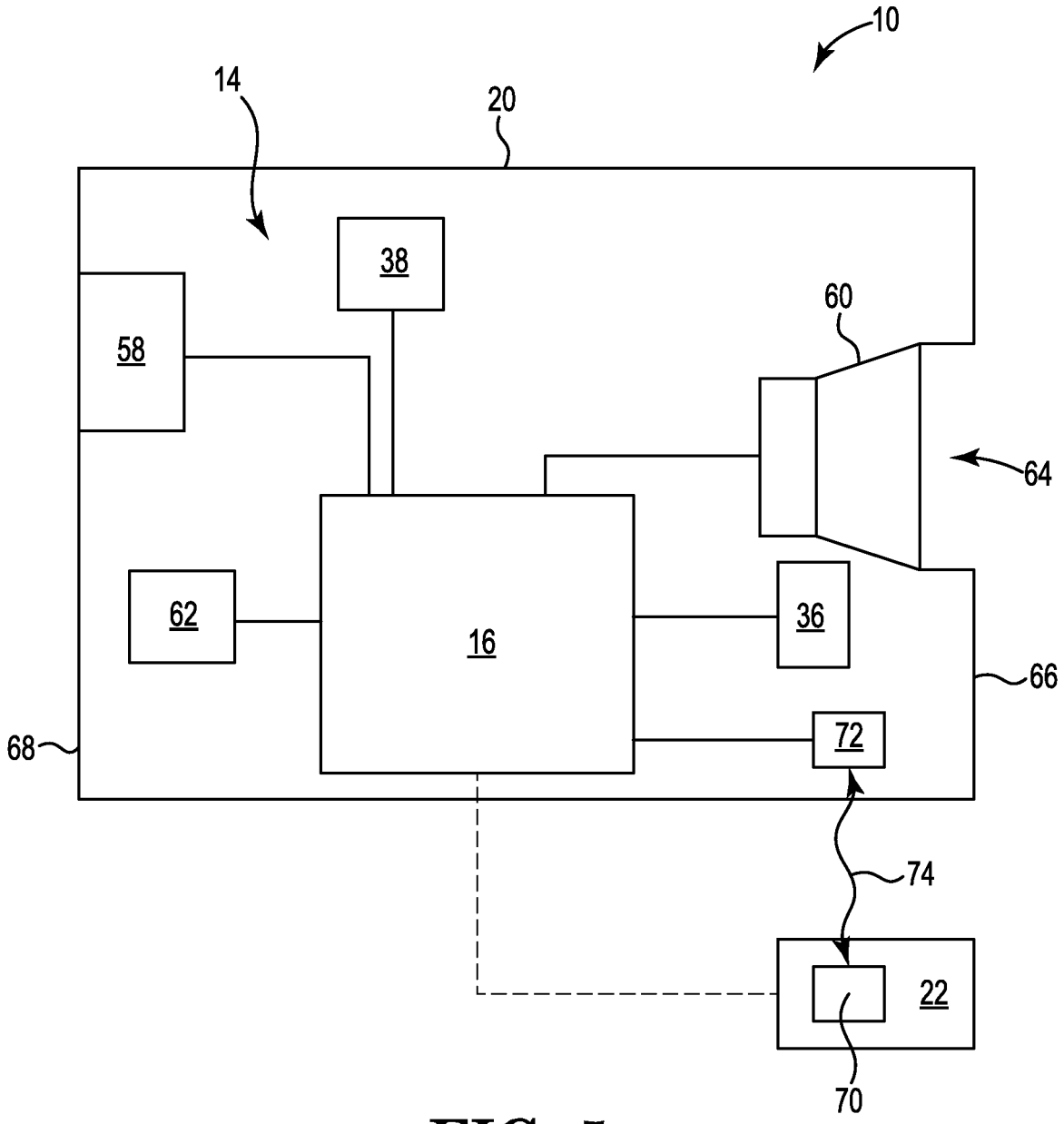
FIG. 5 is a schematic cross-section view of a housing and the sensor of the hearing device of FIG. 1.

Disposed within the housing 12 are electronic components 14 (FIG. 5). The electronic components 14 can be disposed in any suitable location or arrangement within the housing 12. In one or more embodiments, one or more electronic components 14 can be disposed on the top plate 30 and placed within the housing 12 when the top plate is connected to the housing body 28. The hearing device 10 can include any suitable electronic components as is further described herein. In one or more embodiments, the electronic components 14 include the controller 16. Any suitable controller 16 can be utilized with the hearing device 10 as is also further described herein.

Operatively connected to the electronic components 14 is the earpiece 18. Any suitable earpiece 18 can be utilized with the hearing device 10. The earpiece 18 is adapted to be disposed in the ear canal 20 of the ear 2 of the wearer. Further, the earpiece 18 can be operatively connected to the electronic components 14 using any suitable technique or techniques. In one or more embodiments, the earpiece 18 can be operatively connected to the electronic components 14 by a sound tube 34 that extends between the earpiece and the housing 12. The sound tube 34 can be any suitable sound tube or cable. In one or more embodiments, the sound tube 34 can include one or more lumens. Each lumen can provide any suitable information or signal between the earpiece 18 and the electronic components 14. For example, a first lumen can provide acoustic energy from the components 14 to the earpiece 18, and a second lumen can provide electrical energy (e.g., an electrical signal) to the earpiece. In one or more embodiments, one or more wired lumens can provide at least one of electrical power or signals to the earpiece 18.

In one or more embodiments, the sound tube 34 can provide acoustical separation of acoustic signals provided by the components 14. For example, in one or more embodiments, the hearing device 10 can include a woofer disposed on or associated with the housing 12 and a tweeter disposed on or associated with the earpiece 18 such that the tweeter is disposed in the ear canal 20.

Operatively connected to the earpiece 18 is the sensor 22. The hearing device 10 can include the sensor 22 and an optional second sensor 36 disposed on or in the housing 12. Although depicted as including two sensors 22, 36, the hearing device 10 can include any suitable number of sensors, e.g., 1, 2, 3, 4, 5, or more sensors. The sensors 22, 36 can include any suitable sensor or sensors. The sensor 22 can include the same sensor as the second sensor 36. In one or more embodiments, the sensor 22 includes a sensor that is different from that of the second sensor 36. The sensors 22, 36 can be operatively connected to the controller 16 using any suitable technique or techniques, e.g., electrical, optical, or wireless connections. In the embodiment illustrated in FIGS. 1-5, the sensor 22 is operatively connected to the earpiece 18 by the cable 26.

In one or more embodiments, sensor 22 is adapted to detect a physiological characteristic of the wearer and generate a sensor signal based on the physiological characteristic. Further, in one or more embodiments, the optional second sensor 36 is adapted to detect a second physiological characteristic of the wearer and generate a second sensor signal based on the second physiological characteristic. The controller 16 can be adapted to receive the sensor signal from the sensor 22 and the second sensor signal from the second sensor 36. The sensor signals can be analyzed by the controller 16 or transmitted by an antenna 38 of the electronic components 14 to a remote controller or controllers for analysis utilizing any suitable technique or techniques.

The physiological characteristic and the second physiological characteristic can each include any suitable physiological characteristic. The physiological characteristic detected by the sensor 22 can be the same as or different from the second physiological characteristic detected by the second sensor 36. For example, in one or more embodiments, the physiological characteristic detected by the sensor 22 can be a blood pressure of the wearer and the second physiological characteristic detected by the second sensor 36 can be a pulse of the wearer.

The sensors 22, 36 can be disposed in any suitable location. In one or more embodiments, the sensor 22 can be disposed such that it maintains contact with the portion 24 of the ear 2 of the wearer when the earpiece 18 is disposed in the ear canal 20 of the wearer, and the second sensor 36 can be disposed on the side surface 32 of the housing 12 such that is in contact with the pinna 4.

In one or more embodiments, one or more additional sensors can be disposed in any suitable location relative to the housing 12 and the earpiece 18 of the hearing device 10 and operatively connected to the controller 16 or a remote controller using any suitable technique or techniques. In one or more embodiments, one or more additional sensors can be disposed within one or both ears and outside the ear of the wearer. For example, earpiece 18 can include one or more sensors that can be adapted to detect a physiological characteristic of the wearer and generate a sensor signal based on this physiological characteristic. Any suitable physiological characteristic can be detected by the sensor associated with the earpiece 18, e.g., the same physiological characteristics detected by sensors 22, 36.

In general, the sensors utilized with the hearing device 10 (e.g., sensors 22, 36) can include any suitable sensor or sensors, e.g., an electrical sensor, an optical sensor, a pressure sensor, a capacitive sensor, a bioelectrical sensor including biological sensors, bioactive sensors, etc. For example, each of the sensors can include an inertial measurement unit (e.g., accelerometer), gyroscope, heart rate sensor, blood pressure sensor, magnetometer, electrooculography (EOG) sensor, electroencephalography (EEG) sensor, amperometric sensor, blood sugar sensor, light sensor, body temperature sensor, galvanic skin response (GSR) sensor, and combinations thereof.

The sensors can be adapted to detect any suitable physiological characteristic of the wearer. For example, the physiological characteristic can include body position, eye movement, body temperature, heart rate, EEG, skin impedance, and combinations thereof. Further, in one or more embodiments, at least one sensor can include one or more microneedles that are adapted to penetrate an epidermis layer of the wearer, e.g., the epidermis layer of the portion 24 of the ear 2 of the wearer. Such a sensor can be utilized to detect any suitable physiological characteristic of the wearer, e.g., glucose levels of blood of the wearer.

In one or more embodiments, the sensor 22 can be utilized to activate and deactivate the hearing device 10. For example, the sensor 22 can be set to a default low-power proximity mode to detect a pulse of the wearer. Upon detection of a pulse, the controller 16 can be adapted to activate the hearing device 10. After activation of the device 10, if a pulse is not detected by the sensor 22 for a predetermined period of time, then the controller 16 can be adapted to deactivate the device 10.

Further, in one or more embodiments, the sensors can be adapted to detect one or more environmental or ambient characteristics proximate the wearer of the hearing device 10. For example, such sensors can include an ambient temperature sensor, barometer, microphone, GPS sensor, moisture/humidity sensor, image sensor (i.e., a camera), and combinations thereof. The sensors can be adapted to detect any suitable environmental characteristic or characteristics, e.g., temperature, moisture/humidity, sound, light intensity, terrain, elevation, ambient oxygen levels, pollutants, and combinations thereof.

Figure 6:
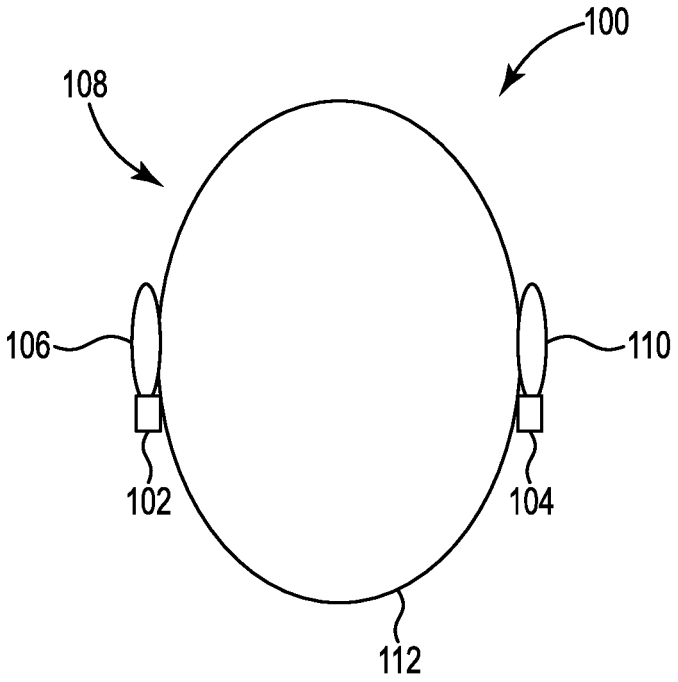
FIG. 6 is a schematic top view of a hearing system that includes a hearing device and a second hearing device disposed on or behind first and second ears of a wearer.

The sensors can also be utilized to electrically connect the hearing device 10 to the wearer's body such that the body can be utilized as an antenna for transmitting information to and from the hearing device. Further, one or more sensors can electrically connect the hearing device 10 to one or more additional body-worn devices by sending electromagnetic signals between the devices through the body. For example, FIG. 6 is a schematic top perspective view of one embodiment of a hearing system 100. The hearing system 100 includes a hearing device 102 and a second hearing device 104. The hearing device 102 is adapted to be worn on or behind a first ear 106 of a wearer 108, and the second hearing device 104 is adapted to be worn on or behind a second ear 110 of the wearer. The hearing devices 102, 104 can include any suitable hearing devices, e.g., hearing device 10 of FIGS. 1-5. In one or more embodiments, the hearing device 102 includes the same hearing device as the second hearing device 104. In one or more embodiments, the hearing device 102 includes a hearing device that is different from that of the second hearing device 104. In one or more embodiments, the hearing device 102 is adapted to communicate with the second hearing device 104 using any suitable technique or techniques.

In one or more embodiments, the first hearing device 102 can include a sensor (sensor 22 of FIG. 1) that is adapted to detect a physiological characteristic of the wearer and generate a sensor signal based on the physiological characteristic. Further, in one or more embodiments, the second hearing device 104 can include a sensor (sensor 22 of FIG. 1) that is adapted to detect a second physiological characteristic of the wearer and generate a second sensor signal based on the physiological characteristic. The physiological characteristic and the second physiological characteristic can each include any suitable physiological characteristic. The physiological characteristic detected by the sensor of the first hearing device 102 can be the same as or different from the second physiological characteristic detected by the sensor of the second hearing device 104. For example, in one or more embodiments, the physiological characteristic detected by the sensor of the first hearing device 102 can be a blood pressure of the wearer and the second physiological characteristic detected by the sensor of the second hearing device 104 can be a pulse of the wearer.

For hearing systems that include two hearing devices, one or more sensors can be utilized for communication between the hearing devices through a skull of the wearer 108, i.e., ear-to-ear communications. Such communication can be utilized to send electromagnetic signals from one device to the other such that the hearing device 102 is adapted to communicate with the second hearing device 104. For example, the wearer can adjust a volume of an acoustic signal provided by the hearing devices 102, 104 by changing the volume on one device, which sends a control signal to the other device that adjusts its volume. Further, in one or more embodiments, sensor data from one or more sensors of one or both of hearing devices 102, 104 can be coordinated between the two hearing devices. In one or more embodiments, the hearing device 102 can be adapted to transmit the sensor signal to the second hearing device 104 and vice versa. For example, an accelerometer disposed in each device 102, 104 can be utilized to determine whether one of the hearing devices 102, 104 has fallen out of the ear of the wearer by indicating an asymmetric response between the two devices. In one or more embodiments, the controller (e.g., controller 16 of FIG. 5) can be adapted to control the sensor of the hearing device 102 and the sensor of the second hearing device 104 such that the sensors of the hearing devices can be alternately activated to reduce power consumption of the hearing system 100.

Returning to FIGS. 1-5, sensor 22 can be adapted to be disposed in any suitable location such that it maintains contact with the wearer. In one or more embodiments, the sensor 22 is adapted to be in contact with the portion 24 of the ear 2 of the wearer when the earpiece 18 is disposed in the ear canal 20 of the wearer. In one or more embodiments, the sensor 22 is adapted to be disposed in a cymba region 40 of the ear 2 of the wearer. In one or more embodiments, the sensor 22 is adapted to be disposed in an antihelix region of the ear 2.

The sensor 22 can include any suitable electronic components or devices. In one or more embodiments, the sensor 22 can include a controller or microprocessor that is adapted to convert the detected physiological characteristic to the signal that is then transmitted to one or more of the electronic components 14 disposed within the housing 12 of the device 10.

As mentioned herein, the sensor 22 can be operatively connected to at least one of the housing 12 or the earpiece 18 of the device 10 using any suitable technique or techniques. In the embodiment illustrated in FIGS. 1-5, the sensor 22 is operatively connected to the earpiece 18 by the cable 26. In one or more embodiments, the cable 26 can operatively connect the sensor 22 to the housing 12. In one or more embodiments, the cable 26 can operatively connect the sensor 22 to the sound tube 34.

The cable 26 can include any suitable cable or cables. Further, the cable 26 can take any suitable shape or shapes and have any suitable dimensions. In one or more embodiments, the cable 26 can be sized and shaped based upon the physiology of the wearer. In one or more embodiments, the cable 26 can be biased to maintain contact between the sensor 22 and the portion of the ear 24 of the wearer when the earpiece 18 is disposed in the ear canal 20 of the wearer.

Figure 3:
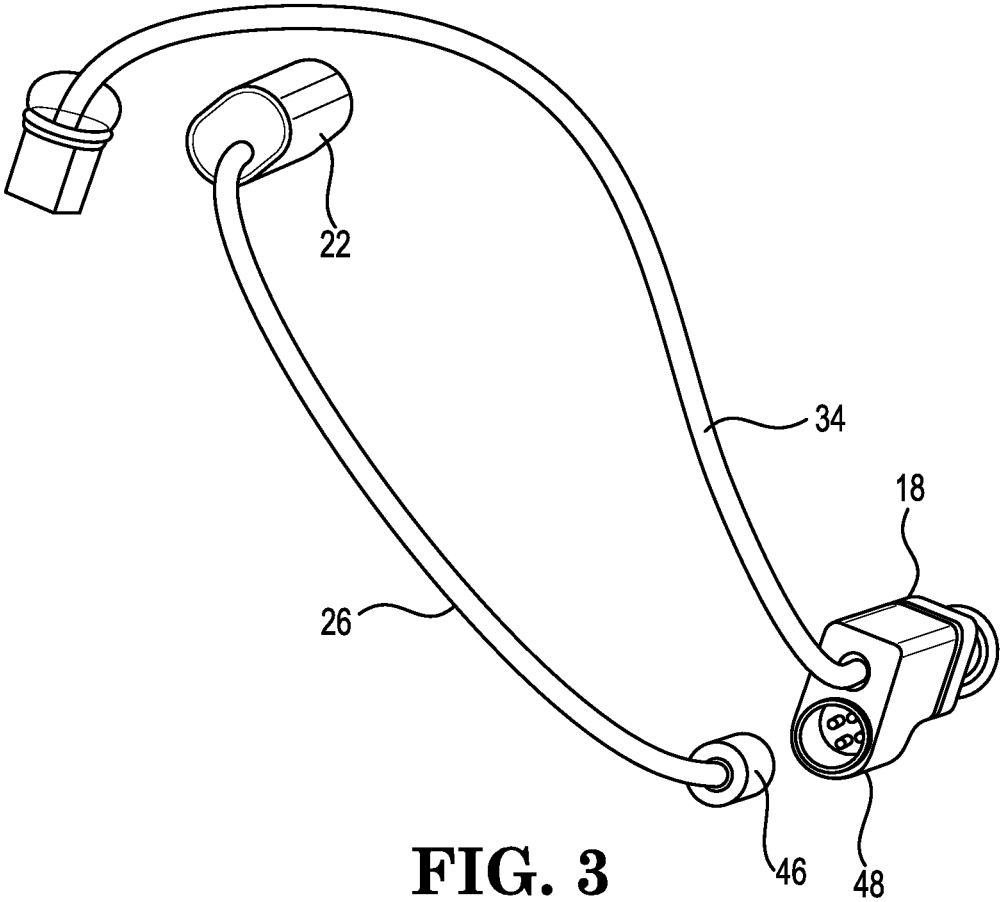
FIG. 3 is a schematic perspective view of a cable that is connected to a sensor of the hearing device of FIG. 1 and disconnected from an earpiece of the hearing device.

The cable 26 includes a body 40 that extends between a first end 42 and a second end 44 of the body. The first end 42 of the body 40 is connected to the sensor 22 using any suitable technique or techniques. In one or more embodiments, the first end 42 of the body 40 can be removably connected to the sensor 22. Further, the second end 44 is connected to the earpiece 18 using any suitable technique or techniques. In one or more embodiments, the cable 26 includes a connector 46 disposed at the second end 44 of the cable that is adapted to connect the cable to the earpiece 18. Although not shown, the cable 26 can include a second connector disposed at the first end 42 of the cable that is adapted to connect the cable to the sensor 22. In one or more embodiments, the connector 46 can include one or more pins that are adapted to be inserted into one or more slots 48 of the earpiece 18 to provide an electrical connection between the sensor 22 and the earpiece. At least one of the connector 46 or the earpiece 18 can include a locking mechanism that retains the connector within the slot 48 of the earpiece during normal use. In one or more embodiments, the cable 26 is removably connected to the earpiece 18 such that the sensor 22 and cable can be removed from the device 10. For example, FIG. 3 is a schematic perspective view of the cable 26 and the earpiece 18, where the connecter 46 of the cable is disconnected from the earpiece 18. Such removable connection between the sensor 22 and the earpiece 18 also allows for different types of sensors to be utilized with the hearing device 10.

As mentioned herein, the cable 26 can be biased to maintain contact between the sensor 22 and the portion 24 of the ear 2 of the wearer using any suitable technique or techniques. In one or more embodiments, the cable 26 can include a polymeric (e.g., nylon) spring that biases the cable to maintain contact between the sensor 22 and the portion 24 of the ear 2 of the wearer when the earpiece 18 is disposed in the ear canal 20 of the wearer. In one or more embodiments, the cable 26 can include a shape-memory material that biases the cable to maintain contact between the sensor 22 and the portion 24 of the ear 2 of the wearer when the earpiece 18 is disposed in the ear canal 20 of the wearer. In one or more embodiments, the cable 26 can also help maintain the earpiece 18 in the ear canal 20 of the wearer.

Figure 4:
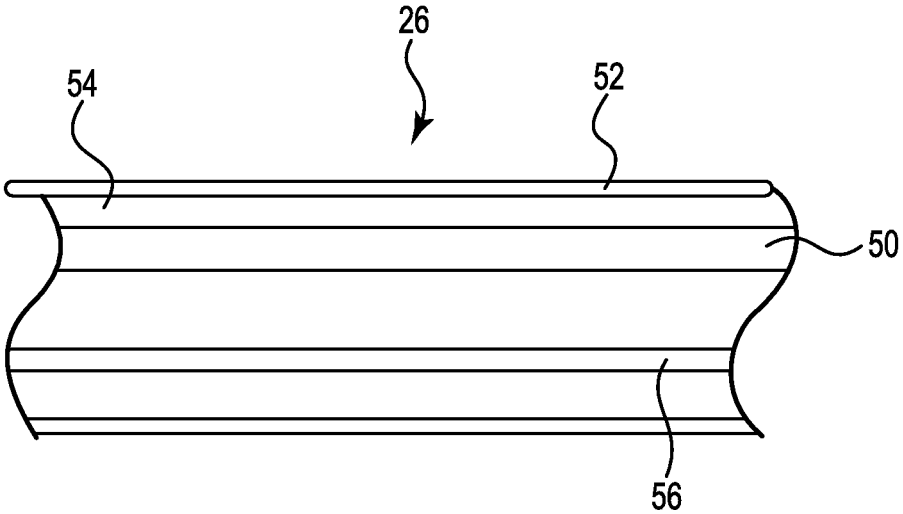
FIG. 4 is a schematic cross-section view of a portion of the cable of the hearing device of FIG. 1.

FIG. 4 is a schematic cross-section view of the cable 26. The cable 26 includes shape-memory material 50 disposed within a body 52 of the cable. The shape-memory material 50 can include any suitable shape-memory material, e.g., nitinol, and alloys that include at least one of zinc, copper, gold, and iron such as copper-aluminum-nickel alloy. The shape-memory material 50 can be disposed within the body 52 of the cable 26 using any suitable technique or techniques. In one or more embodiments, the body 52 of the cable 26 can include a sheath or tube 54 that can be slid over the shape-memory material 50 and connected to at least one of the sensor 22 or the connector 44 using any suitable technique or techniques.

In one or more embodiments, the cable 26 can include one or more conductors 56 that can operatively connect the sensor 22 to at least one of the electronic components 14 disposed within the housing 12 and the earpiece 18. The conductor 56 can include any suitable conductive material or materials. The conductor 56 electrically connects the sensor 22 to the electronic components 14 in the housing either directly or through the earpiece 18 and sound tube 34. In one or more embodiments, the shape-memory material 50 can electrically connect the sensor 22 to the electronic components 14 in the housing 12 either directly or through the earpiece 18 and sound tube 34. Further, the conductor 56 can be disposed within the cable 26 using any suitable technique or techniques. In one or more embodiments, the sheath 54 can be slid over both the shape-memory material 50 and the conductor 56 and connected to at least one of the sensor 22 and the connector 44 using any suitable technique or techniques.

In one or more embodiments, the cable 26 can be shaped to provide one or more gripping portions such that the wearer can more easily insert the earpiece 18 into the ear canal 20 and remove the device from the ear 2. Any suitable shape or shapes of cable 26 can be utilized to provide the gripping portion. In one or more embodiments, the body 52 of the cable 26 can include one or more textured regions (not shown) that are adapted for the wearer to more easily grasp the cable for insertion and removal of the hearing device 10.

The cable 26 can provide a bias force or contact pressure to the sensor 22 such that the sensor remains in contact with the wearer. The cable 26 can exhibit any suitable bias force.

The hearing device 10 can include any suitable electronic component or components 14. For example, FIG. 5 is a schematic cross-section view of the hearing device 10 of FIGS. 1-4. Electronic components 14 are disposed within the housing 12 of the device 10. The electronic components 14 can include any suitable device or devices, e.g., integrated circuits, power sources, microphones, receivers, etc. For example, in one or more embodiments, the components 14 can include the controller 16, a microphone 58, a receiver 60 (e.g., speaker), a power source 62, the antenna 38, the sensor 22, and the optional second sensor 36. The microphone 58, receiver 60, power source 62, antenna 38, and sensors 22, 36 can be electrically connected to the controller 16 using any suitable technique or techniques.

Any suitable controller 16 can be utilized with the hearing device 10. For example, in embodiments where the hearing device 10 is utilized as a hearing aid, the controller 16 can be adapted to employ programmable gains to adjust the hearing device output to the wearer's hearing impairment. The controller 16 can be a digital signal processor (DSP), microprocessor, microcontroller, other digital logic, or combinations thereof. The processing can be done by a single processor or can be distributed over different devices. The processing of signals referenced in this disclosure can be performed using the controller 16 or over different devices.

The processing of signals referenced in this application can be performed using the processor or other different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In one or more embodiments, the controller 16 or other processing devices execute instructions to perform signal processing tasks. Such embodiments can include analog components in communication with the controller 16 to perform signal processing tasks, such as sound reception by the microphone 58, or playing of sound using the receiver 60.

The electronic components 14 can also include the microphone 58 that is electrically connected to the controller 16. Although one microphone 58 is depicted, the components 14 can include any suitable number of microphones. Further, the microphone 58 can be disposed in any suitable location within the housing 12. For example, in one or more embodiments, a port or opening can be formed in the housing 12, and the microphone 58 can be disposed adjacent the port to receive audio information from the wearer's environment.

Any suitable microphone 58 can be utilized. In one or more embodiments, the microphone 58 can be selected to detect one or more audio signals and convert such signals to an electrical signal that is provided to the processor. Although not shown, the controller 16 can include an analog-to-digital convertor that converts the electrical signal from the microphone 58 to a digital signal.

Electrically connected to the controller 16 is the receiver 60. Any suitable receiver can be utilized. In one or more embodiments, the receiver 60 can be adapted to convert an electrical signal from the controller 16 to an acoustic output or sound that can be transmitted from the housing 12 to the wearer via the earpiece 18. In one or more embodiments, the receiver 60 can be disposed adjacent an opening 64 disposed in a first end 66 of the housing 12. As used herein, the term "adjacent the opening" means that the receiver 60 is disposed closer to the opening 64 in the first end 66 of the housing 12 than to a second end 68 of the housing. The opening 64 can be connected to the sound tube 34 such that one or both of acoustic and electrical energy can be directed between the housing 12 and the earpiece 18.

The power source 62 is electrically connected to the controller 16 and is adapted to provide electrical energy to the controller and one or more of the other electronic components 14. In one or more embodiments, the power source 62 can also provide electrical energy to at least one of the sensor 22 and earpiece 18. In one or more embodiments, the sensor 22 can include a separate power source disposed in a housing of the sensor or in the cable 26. The power source 62 can include any suitable power source or power sources, e.g., a battery. In one or more embodiments, the power source 62 can include a rechargeable battery. In one or more embodiments, the components 14 can include two or more power sources 62.

The electronic components 14 can also include the optional antenna 38 Any suitable antenna or combination of antennas can be utilized. In one or more embodiments, the antenna 38 can include one or more antennas having any suitable configuration. For example, antenna configurations can vary and can be included within the housing 12 or be external to the housing. Further, the antenna 38 can be compatible with any suitable protocol or combination of protocols. In one or more embodiments, the components 14 can also include a transmitter that transmits electromagnetic signals and a radio-frequency receiver that receives electromagnetic signals using any suitable protocol or combination of protocols.

For example, in one or more embodiments, the hearing device 10 can be connected to one or more external devices using, e.g., Bluetooth, Wi-Fi, magnetic induction, etc. For example, in one or more embodiments, the hearing device 10 can be wirelessly connected to the Internet using any suitable technique or techniques. Such connection can enable the hearing device 10 to access any suitable databases, including medical records databases, cloud computing databases, location services, etc. In one or more embodiments, the hearing device 10 can be wirelessly connected utilizing the Internet of Things (IoT) such that the hearing device can communicate with, e.g., hazard beacons, one or more cameras disposed in proximity to the wearer, motion sensors, room lights, etc.

In embodiments where the hearing device 10 includes a second hearing device disposed on an opposite side of the wearer's head (e.g., second hearing device 104 of system 100 of FIG. 6), the antenna 38 can be utilized to communicate with an antenna of the second hearing device. In one or more embodiments, a low-power link across the wearer's head can be utilized to transmit electromagnetic signals between the first and second hearing devices.

In one or more embodiments, the sensor 22 can include emitter 70 that can be adapted to emit a transmissive signal 74 that can be detected by a detector 72 disposed on or within the housing 12 of the hearing device 10. For example, in one or more embodiments, the emitter 70 of the sensor 22 can be adapted to emit electromagnetic radiation 74 that is directed through the ear 2 of the wearer and detected by the detector 72. Such detected electromagnetic radiation (e.g., transmissive signal) can be utilized to detect a physiological characteristic of the wearer, e.g., blood oxygen levels. The emitter 70 can be adapted to emit electromagnetic radiation of any suitable wavelength or wavelength band. In one or more embodiments, the emitter 70 can be adapted to emit at least one of ultraviolet, visible, and infrared electromagnetic radiation. Further, the detector 72 of the electronic components 14 can be adapted to detect any suitable wavelength or wavelength band. In one or more embodiments, the detector 72 can be adapted to detect at least one of ultraviolet, visible, and infrared electromagnetic radiation. Although depicted as include the emitter 70, the sensor 22 can instead include a detector that is adapted to detect electromagnetic radiation (e.g., a transmissive signal) emitted by an emitter of the electronic components 14. In one or more embodiments, the sensor 22 can include an emitter and a detector, and the electronic components can also include an emitter and a detector.

All headings provided herein are for the convenience of the reader and should not be used to limit the meaning of any text that follows the heading, unless so specified.

The terms "comprises" and variations thereof do not have a limiting meaning where these terms appear in the description and claims. Such terms will be understood to imply the inclusion of a stated step or element or group of steps or elements but not the exclusion of any other step or element or group of steps or elements.

In this application, terms such as "a," "an," and "the" are not intended to refer to only a singular entity, but include the general class of which a specific example may be used for illustration. The terms "a," "an," and "the" are used interchangeably with the term "at least one." The phrases "at least one of" and "comprises at least one of" followed by a list refers to any one of the items in the list and any combination of two or more items in the list.

The phrases "at least one of" and "comprises at least one of" followed by a list refers to any one of the items in the list and any combination of two or more items in the list.

As used herein, the term "or" is generally employed in its usual sense including "and/or" unless the content clearly dictates otherwise.

The term "and/or" means one or all of the listed elements or a combination of any two or more of the listed elements.

As used herein in connection with a measured quantity, the term "about" refers to that variation in the measured quantity as would be expected by the skilled artisan making the measurement and exercising a level of care commensurate with the objective of the measurement and the precision of the measuring equipment used. Herein, "up to" a number (e.g., up to 50) includes the number (e.g., 50).

Also herein, the recitations of numerical ranges by endpoints include all numbers subsumed within that range as well as the endpoints (e.g., 1 to 5 includes 1, 1.5, 2, 2.75, 3, 3.80, 4, 5, etc.).

All references and publications cited herein are expressly incorporated herein by reference in their entirety into this disclosure, except to the extent they may directly contradict this disclosure. Illustrative embodiments of this disclosure are discussed and reference has been made to possible variations within the scope of this disclosure. These and other variations and modifications in the disclosure will be apparent to those skilled in the art without departing from the scope of the disclosure, and this disclosure is not limited to the illustrative embodiments set forth herein. Accordingly, the disclosure is to be limited only by the claims provided below.

What is claimed is:

1. A hearing device comprising:

a housing adapted to be worn on or behind an ear of a wearer;

electronic components disposed within the housing, wherein the electronic components comprise a controller;

an earpiece adapted to be disposed in an ear canal of the ear of the wearer, wherein the earpiece is operatively connected to the electronic components disposed within the housing;

a sensor adapted to be in contact with a portion of the ear of the wearer, wherein the sensor is further adapted to detect a physiological characteristic of the wearer and generate a sensor signal based on the physiological characteristic that is received by the controller of the electronic components disposed within the housing; and a cable that operatively connects the sensor to the earpiece, wherein the cable is biased to maintain contact between the sensor and the portion of the ear of the wearer when the earpiece is disposed in the ear canal of the wearer.

2. The hearing device of claim 1, wherein the cable comprises a shape-memory material that biases the cable to maintain contact between the sensor and the portion of the ear of the wearer when the earpiece is disposed in the ear canal of the wearer.

3. The hearing device of claim 2, wherein the shape-memory material comprises nitinol.

4. The hearing device of claim 2, wherein the cable further comprises a sheath, wherein the shape-memory material is disposed within sheath.

5. The hearing device of claim 1, wherein the cable further comprises a conductor that electrically connects the sensor to the earpiece.

6. The hearing device of claim 1, wherein the sensor is adapted to be disposed in a cymba region of the ear of the wearer.

7. The hearing device of claim 1, wherein the cable is removably connected to the earpiece.

8. The hearing device of claim 1, wherein the sensor further comprises at least one of an optical sensor, a bioelectrical sensor, or an environmental sensor.

9. The hearing device of claim 8, wherein the sensor comprises at least one of an EOG, EEG, EMG, GSR, or amerometric sensor.

10. The hearing device of claim 1, further comprising a second sensor disposed on a side surface of the housing and electrically connected to the controller, wherein the second sensor is adapted to be in contact with either a pinna or a skull of the wearer, wherein the second sensor is further adapted to detect a second physiological characteristic of the wearer and generate a second sensor signal based on the second physiological characteristic.

11. The hearing device of claim 1, wherein the electronic components further comprise at least one of a microphone, a receiver, a power source, and an antenna.

12. The hearing device of claim 1, wherein the sensor further comprises at least one of an inertial measurement unit, a pressure sensor, and a capacitive sensor.

13. The hearing device of claim 1, wherein the sensor comprises an emitter and the electronic components comprise a detector adapted to receive a transmissive signal emitted by the emitter.

14. The hearing device of claim 1, wherein the electronic components comprise an emitter and the sensor comprises a detector adapted to receive a transmissive signal emitted by the emitter of the electronic components.

15. The hearing device of claim 1, wherein the controller is adapted to deactivate the electronic components based upon the sensor signal.

16. The hearing device of claim 1, wherein the sensor further comprises a microneedle that is adapted to penetrate an epidermis layer of the portion of the ear of the wearer.

17. The hearing device of claim 1, wherein the earpiece comprises a sensor adapted to be in contact with the ear canal of the wearer, wherein the sensor is further adapted to detect a physiological characteristic of the wearer and generate a sensor signal based on the physiological characteristic.

18. A hearing system comprising the hearing device of claim 1 and a second hearing device, wherein the second hearing device comprises:

a housing adapted to be worn on or behind a second ear of the wearer;

electronic components disposed within the housing, wherein the electronic components comprise a controller;

an earpiece adapted to be disposed in an ear canal of the second ear of the wearer, wherein the earpiece is operatively connected to the electronic components disposed within the housing;

a sensor adapted to be in contact with a portion of the second ear of the wearer, wherein the sensor is further adapted to detect a second physiological characteristic of the wearer and generate a second sensor signal based on the second physiological characteristic that is received by the controller of the electronic components disposed within the housing; and a cable that operatively connects the sensor to the earpiece, wherein the cable is biased to maintain contact between the sensor and the portion of the second ear of the wearer when the earpiece is disposed in the ear canal of the wearer;

wherein the hearing device is further adapted to communicate with the second hearing device.

19. The hearing system of claim 18, wherein the hearing device is further adapted to transmit the sensor signal to the second hearing device.

20. The hearing system of claim 18, wherein the controller of the hearing device is further adapted to control the sensor of the hearing device and the sensor of the second hearing device such that the sensors of the hearing device and second hearing device can be alternately activated.

* * * * *